US012410660B1

(12) United States Patent
Yang et al.

(10) Patent No.: US 12,410,660 B1
(45) Date of Patent: Sep. 9, 2025

(54) FULL-FACE SHAFT BORING MACHINE, BORING SYSTEM, AND BORING METHOD

(71) Applicants: University of Science and Technology Beijing, Beijing (CN); China University of Mining and Technology-Beijing, Beijing (CN)

(72) Inventors: Renshu Yang, Beijing (CN); Liyun Yang, Beijing (CN); Yiqiang Kang, Beijing (CN); Zhengbai Chen, Beijing (CN); Huidong Xu, Beijing (CN); Donghui Man, Beijing (CN); Bingyu Liu, Beijing (CN); Xuejun Sun, Beijing (CN); Fei Ma, Beijing (CN); Chaoyang Sun, Beijing (CN); Xinmin Ma, Beijing (CN); Liang Ma, Beijing (CN); Gang Niu, Beijing (CN); Qunshan Yang, Beijing (CN); Ning Liu, Beijing (CN); Weiqiang Chen, Beijing (CN); Siyuan Huang, Beijing (CN); Man Yao, Beijing (CN); Jinjun Liao, Beijing (CN); Bin Xu, Beijing (CN); Huaquan Zhang, Beijing (CN); Qingping Chai, Beijing (CN); Zhidong Guo, Beijing (CN); Hechao Zhu, Beijing (CN); Yong Wang, Beijing (CN); Yongping Shao, Beijing (CN)

(73) Assignees: University of Science and Technology Beijing, Beijing (CN); China University of Mining and Technology-Beijing, Beijing (CN)

( * ) Notice: Subject to any disclaimer, the term of this patent is extended or adjusted under 35 U.S.C. 154(b) by 0 days.

(21) Appl. No.: 19/018,097

(22) Filed: Jan. 13, 2025

(51) Int. Cl.
*E21B 10/42* (2006.01)
*E21B 7/00* (2006.01)
(Continued)

(52) U.S. Cl.
CPC ..... *E21B 10/42* (2013.01); *E21B 7/003* (2013.01); *E21B 21/00* (2013.01); *E21B 41/00* (2013.01); *E21D 5/04* (2013.01)

(58) Field of Classification Search
CPC ..... E21B 10/42; E21B 7/003; E21B 21/00; E21B 41/00; E21D 5/04; E21D 5/00; E21D 9/11; E21D 9/12
See application file for complete search history.

(56) References Cited

U.S. PATENT DOCUMENTS 3,778,107 A * 12/1973 Haspert ..... E21D 9/112 299/33
4,576,515 A * 3/1986 Morimoto ..... E21B 7/208 405/184
(Continued)

FOREIGN PATENT DOCUMENTS

CN 105545317 A * 5/2016
CN 108825153 A * 11/2018
(Continued)

*Primary Examiner* — Daniel P Stephenson
(74) *Attorney, Agent, or Firm* — Thomas Horstemeyer, LLP

(57) ABSTRACT

Disclosed is a full-face shaft boring machine, a boring system and a boring method. The full-face shaft boring machine includes a cutterhead structure provided with an outer tapered surface structure protruding in a boring direction. The outer tapered surface structure surrounds an outer circumferential side of the rotation center of the cutterhead structure, and a radial cross section of the outer tapered surface structure gradually decreases in the boring direction; at least one receiving port for rock slag to pass through is formed at the taper top of the outer tapered surface structure and runs through the cutterhead structure in the boring direction; and a slag discharging assembly for discharging the rock slag is arranged on a side of the cutterhead structure away from the boring direction.

18 Claims, 9 Drawing Sheets

(51) Int. Cl.

| | |
|---|---|
| ***E21B 21/00*** | (2006.01) |
| ***E21B 41/00*** | (2006.01) |
| ***E21D 5/04*** | (2006.01) |

(56) References Cited

U.S. PATENT DOCUMENTS

| | | | | |
|---|---|---|---|---|
| 7,510,025 | B2 * | 3/2009 | Davies | E21B 7/046 299/1.8 |
| 10,900,302 | B2 * | 1/2021 | Kysely | E21B 7/046 |
| 11,905,835 | B1 * | 2/2024 | Khorshidi | E21D 9/0879 |
| 2007/0089906 | A1 * | 4/2007 | Davies | E21D 9/093 175/26 |

FOREIGN PATENT DOCUMENTS

| | | | | | |
|---|---|---|---|---|---|
| CN | 111684144 | A | * | 9/2020 | E21D 20/003 |
| CN | 111980719 | A | * | 11/2020 | E21D 9/02 |
| CN | 111852493 | B | * | 11/2021 | E21D 11/08 |
| CN | 116517575 | A | * | 8/2023 | |
| WO | WO-2016141897 | A1 | * | 9/2016 | E21C 25/00 |
| WO | WO-2024027851 | A1 | * | 2/2024 | C04B 38/02 |

* cited by examiner

FULL-FACE SHAFT BORING MACHINE, BORING SYSTEM, AND BORING METHOD

TECHNICAL FIELD

The present disclosure relates to the technical field of shaft boring equipment and shaft construction, and in particular to a full-face shaft boring machine, a boring system and a boring method.

BACKGROUND

At present, shaft construction is still performed mainly by a drilling and blasting method, and therefore it is the primary technical objective for relevant technical researches to develop a full-face shaft boring machine to achieve mechanized construction of shaft without worker working inside the shaft. In order to solve the technical problem above, some types of full-face shaft boring machines were developed. However, all of these techniques are developed by learning from full-face tunnel boring machines for horizontal boring. Each of the cutterhead structures of the tunnel boring machines is generally configured as a planar cutterhead, which is not conducive to gathering rock slag during the shaft construction. Also, there are two working conditions of water-mixed or water-free slag discharging depending on the water content of a formation, which cannot be solved. In addition, shaft supporting can only be constructed by concreting process referring to the drilling and blasting method in which the supporting speed is slow and the initial setting time is long, resulting in low overall construction efficiency.

SUMMARY

It is an objective of the present disclosure to provide a full-face shaft boring machine, a boring system and a boring method in order to solve the above-mentioned problem existing in the prior art and to improve the efficiency of gathering rock slag, discharging the slag and boring.

To achieve the above objective, the present disclosure provides the following solutions. The present disclosure provides a full-face shaft boring machine, a boring system and a boring method. The full-face shaft boring machine includes a cutterhead structure provided with an outer tapered surface structure protruding in a boring direction. The outer tapered surface structure surrounds an outer circumferential side of a rotation center of the cutterhead structure, and a radial cross section of the outer tapered surface structure gradually decreases in the boring direction. An least one receiving port for rock slag to pass through is formed at a taper top of the outer tapered surface structure and runs through the cutterhead structure in the boring direction. A slag discharging assembly for discharging the rock slag is arranged on a side of the cutterhead structure away from the boring direction.

Preferably, an inner tapered surface structure protruding in a direction opposite the boring direction is coaxially arranged with the cutterhead structure and at the rotation center of the cutterhead structure, a radial cross section of the inner tapered surface structure gradually decreases in the direction opposite the boring direction, and an outer circumferential edge of a taper bottom of the inner tapered surface structure is connected to an outer circumferential edge of the taper top of the outer tapered surface structure.

Preferably, a taper angle of the outer tapered surface structure ranges from 90° to 110°, and a taper angle of the inner tapered surface structure ranges from 90° to 160°.

Preferably, connection between the outer circumferential edge of the taper bottom of the inner tapered surface structure and the outer circumferential edge of the taper top of the outer tapered surface structure forms an annular collection groove for gathering the rock slag, the annular collection groove is in communication with the at least one receiving port, and a feeding end of the slag discharging assembly is arranged at the annular collection groove.

Preferably, the slag discharging assembly includes a dry-type slag discharging mechanism including bucket wheel machines, a slag gathering bin and a chain bucket machine. Each of the bucket wheel machines includes a reciprocating conveyor mechanism arranged obliquely, a feeding end of the reciprocating conveyor mechanism is close to the taper top of the outer tapered surface structure, a discharging end of the reciprocating conveyor mechanism extends in the direction opposite the boring direction and is close to the rotation center of the cutterhead structure, and a plurality of scoopers for scooping up the rock slag are arranged on the reciprocating conveyor mechanism. The slag gathering bin is arranged on the side of the cutterhead structure away from the boring direction, spaced from the cutterhead structure and located at the rotation center of the cutterhead structure, and the slag gathering bin is in communication with the discharging end of the reciprocating conveyor mechanism. The chain bucket machine is located on a side of the slag gathering bin away from the boring direction, a feeding end of the chain bucket machine is in communication with the slag gathering bin, and a discharging end of the chain bucket machine extends in the direction opposite the boring direction and is in communication with a rock slag output mechanism.

Preferably, the slag gathering bin is of a tapered cylinder structure with a top opening, a radial cross section of the slag gathering bin gradually decreases in the boring direction, the slag gathering bin is formed with openings at an outer circumferential side of an axis of the slag gathering bin, and the discharging end of the reciprocating conveyor mechanism passes through a corresponding one of the openings and is in communication with the slag gathering bin; the feeding end of the chain bucket machine extends into the slag gathering bin through the top opening of the slag gathering bin and extends to a taper top of the slag gathering bin.

Preferably, the slag discharging assembly further includes a wet-type slag discharging mechanism including a slag discharging pipe and a slag slurry pump arranged on the slag discharging pipe. A feeding end of the slag discharging pipe is close to the taper top of the outer tapered surface structure, and a discharging end of the slag discharging pipe extends in the direction opposite the boring direction and is in communication with a rock slag separation station; the rock slag separation station is provided with a slag outlet for discharging separated rock slag and a slurry outlet for discharging separated slurry, the slag outlet is in communication with the rock slag output mechanism, the slurry outlet is in communication with a slurry replenishing pipe, and a discharging end of the slurry replenishing pipe extends to the taper top of the outer tapered surface structure.

The present disclosure further provides a boring system, including a full-face shaft boring machine and a supporting assembly associated with the full-face shaft boring machine. The supporting assembly includes a concrete casting formwork adapted to an internal circumferential wall of the shaft;

the concrete casting formwork is adjacent to the inner circumferential wall of the shaft, and a first casting structure is connected between the concrete casting formwork and the inner circumferential wall of the shaft; close-up formworks are arranged respectively above and below the concrete casting formwork, one end of one of the close-up formworks is articulated to a top end edge of the concrete casting formwork, an other end of the one of the close-up formworks abuts against the inner circumferential wall of the shaft located above the concrete casting formwork, one end of an other of the close-up formworks is articulated to a bottom end edge of the concrete casting formwork, and an other end of the other of the close-up formworks abuts against the inner circumferential wall of the shaft located below the concrete casting formwork.

Preferably, the boring system further includes a hanging scaffold mechanism including at least an upper hanging scaffold, a middle hanging scaffold and a lower hanging scaffold that are arranged sequentially in the boring direction. An anchor bolt and anchor rope drilling machine and concrete spraying arms are arranged on the lower hanging scaffold, an anchor bolt and anchor rope tensioning device and a mobile concrete mixing station are arranged on the middle hanging scaffold, and the rock slag output mechanism is arranged on the upper hanging scaffold; the concrete spraying arms are in communication with the mobile concrete mixing station through flexible pipes and capable of being deployed to the upper hanging scaffold, the middle hanging scaffold and the lower hanging scaffold. The supporting assembly is located between the upper hanging scaffold and the middle hanging scaffold.

The present disclosure further provides a boring method applying the boring system, including:

S1, continuously propelling the cutterhead structure under action of a thrust and torque of a main shaft of the boring machine to break a working face rock mass into blocky and powdery rock slag;

S2, adopting the dry-type slag discharging mechanism to discharge the rock slag in a case that an amount of water gushing from formation is less than a predetermined value, and adopting the wet-type slag discharging mechanism to discharge the rock slag in a case that the amount of water gushing from formation is greater than the predetermined value; and S3, when continuously boring is performed by a height of a supporting section, lowering the hanging scaffold mechanism to the supporting section, and operating personnel entering the lower hanging scaffold to observe an integrity of a surrounding rock at the inner circumferential wall of the shaft and select a required supporting form to support the surrounding rock.

Compared with the conventional art, the present disclosure has the following technical effects.

In a shaft boring process, the cutterhead structure bores in a vertical direction, the receiving port formed at the taper top of the outer tapered surface structure is the lowest point, and the outer tapered surface structure breaks rocks along with the cutterhead structure; a shaft bottom wall is formed with an annular tapered groove corresponding to the outer tapered surface structure, a radial cross section of the annular tapered groove gradually decreases in the boring direction, the rock slag slips downward along an inner wall surface of the annular tapered groove and is gradually collected at the bottom of the annular tapered groove, and a taper top portion of the outer tapered surface structure is similarly located at the bottom of the annular tapered groove, so that the gathered rock slag can be scooped up by means of the slag scraper, passed through the cutterhead structure and thus piled above the cutterhead structure. The whole cutterhead structure is designed such that the rock slag generated in the rock breaking process can be rapidly collected and quickly moved away from a boring surface through the receiving port, so as to effectively improve the boring efficiency and solve the problem that a planar cutterhead in the prior art is not conducive to gathering rock slag during shaft construction and thus the boring efficiency is affected.

BRIEF DESCRIPTION OF THE DRAWINGS

In order to illustrate the technical solutions in embodiments of the present disclosure or in the prior art more clearly, a brief introduction to the accompanying drawings required for the embodiments will be provided below. Obviously, the accompanying drawings in the following description merely illustrates some of the embodiments of the present disclosure, and those of ordinary skill in the art can also obtain other drawings according to these drawings without inventive effort.

wherein: 1—cutterhead structure, 2—receiving port, 3—bucket wheel machine, 4—slag gathering bin, 5—chain bucket machine, 6—slag chute, 7—slag bucket, 8—slag discharging pipe, 9—slag slurry pump, 10—slurry replenishing pipe, 11—rock slag separation station, 12—slag transferring pipe, 13—lower hanging scaffold, 14—middle hanging scaffold, 15—upper hanging scaffold, 16—anchor bolt and anchor rope drilling machine, 17—concrete spraying arm, 18—mobile concrete mixing station, 19—anchor bolt and anchor rope tensioning device, 20—concrete casting formwork, 21—surrounding rocks of Class I and II, 22—surrounding rock of Class IV, 23—surrounding rock of Class III, 24—anchor bolt, 25—anchor rope, 26—double-layer reinforcing mesh, 27—steel arch, 28—second casting structure, 29—pallet, 30—corrugated steel tube piece, 31—first casting structure, 32—hanging lug, 33—reserved hole, 34—close-up formwork, 35—slag scraper, 36—outer tapered surface structure, and 37—inner tapered surface structure.

DETAILED DESCRIPTION OF THE EMBODIMENTS

The technical solutions in the embodiments of the present disclosure will be clearly and completely described below in conjunction with the accompanying drawings in the embodiments of the present disclosure. Apparently, the embodiments described are merely some rather than all of the embodiments of the present disclosure. On the basis of the embodiments in the present disclosure, all the other embodiments that would have been obtained by those of ordinary skill in the art without inventive effort shall fall within the scope of protection of the present disclosure.

It is an objective of the present disclosure to provide a full-face shaft boring machine, a boring system and a boring method so as to solve the above-mentioned problem existing in the prior art and to improve the efficiencies of gathering rock slag, discharging rock slag and boring.

To make the above objective, features and advantages of the present disclosure clearer and more comprehensible, the present disclosure will be further described in detail below with reference to the accompanying drawings and specific implementations.

Figure 1:
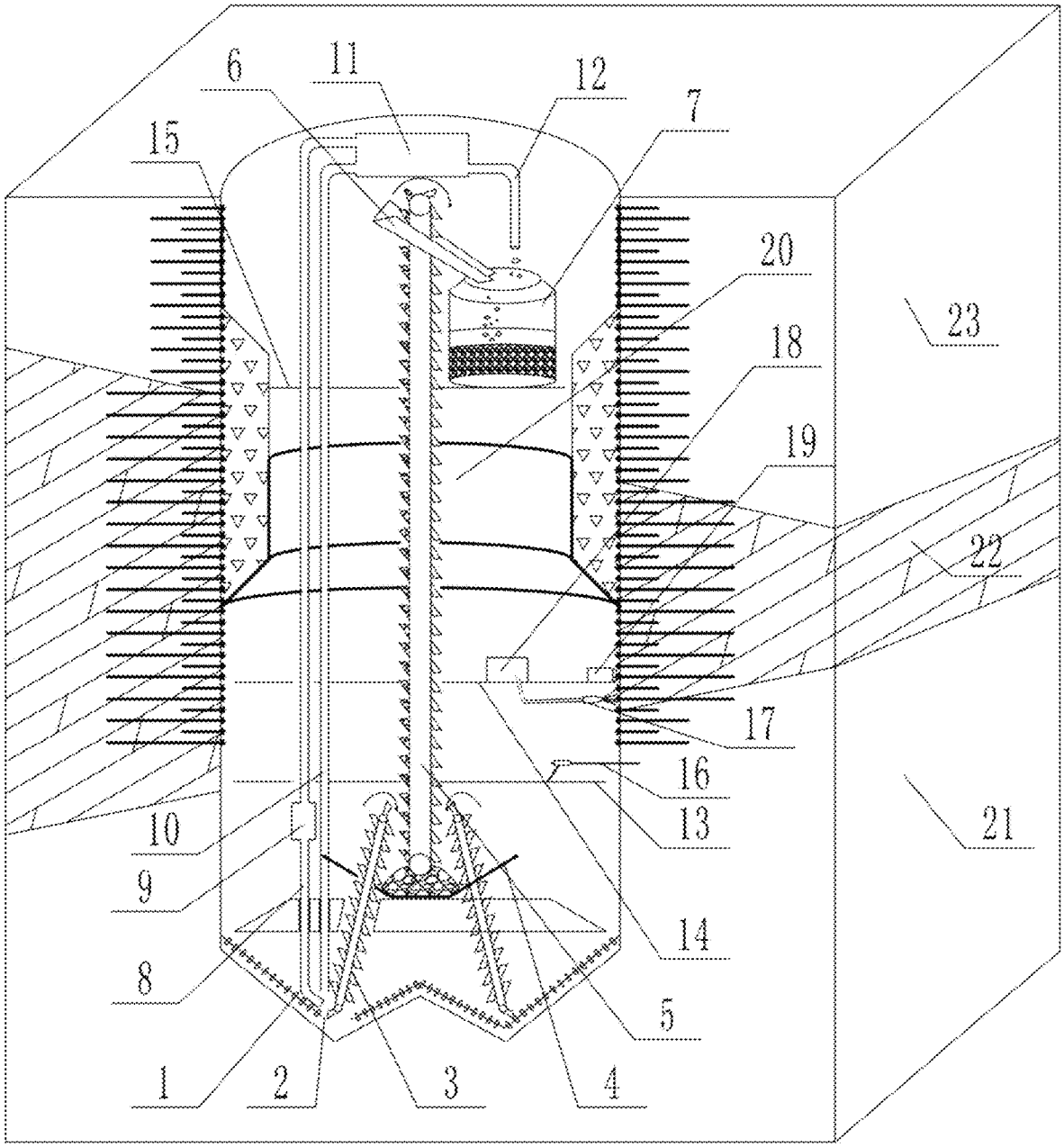
FIG. 1 is a schematic diagram of a boring process of an overall boring system according to an embodiment of the present disclosure.
Figure 2:
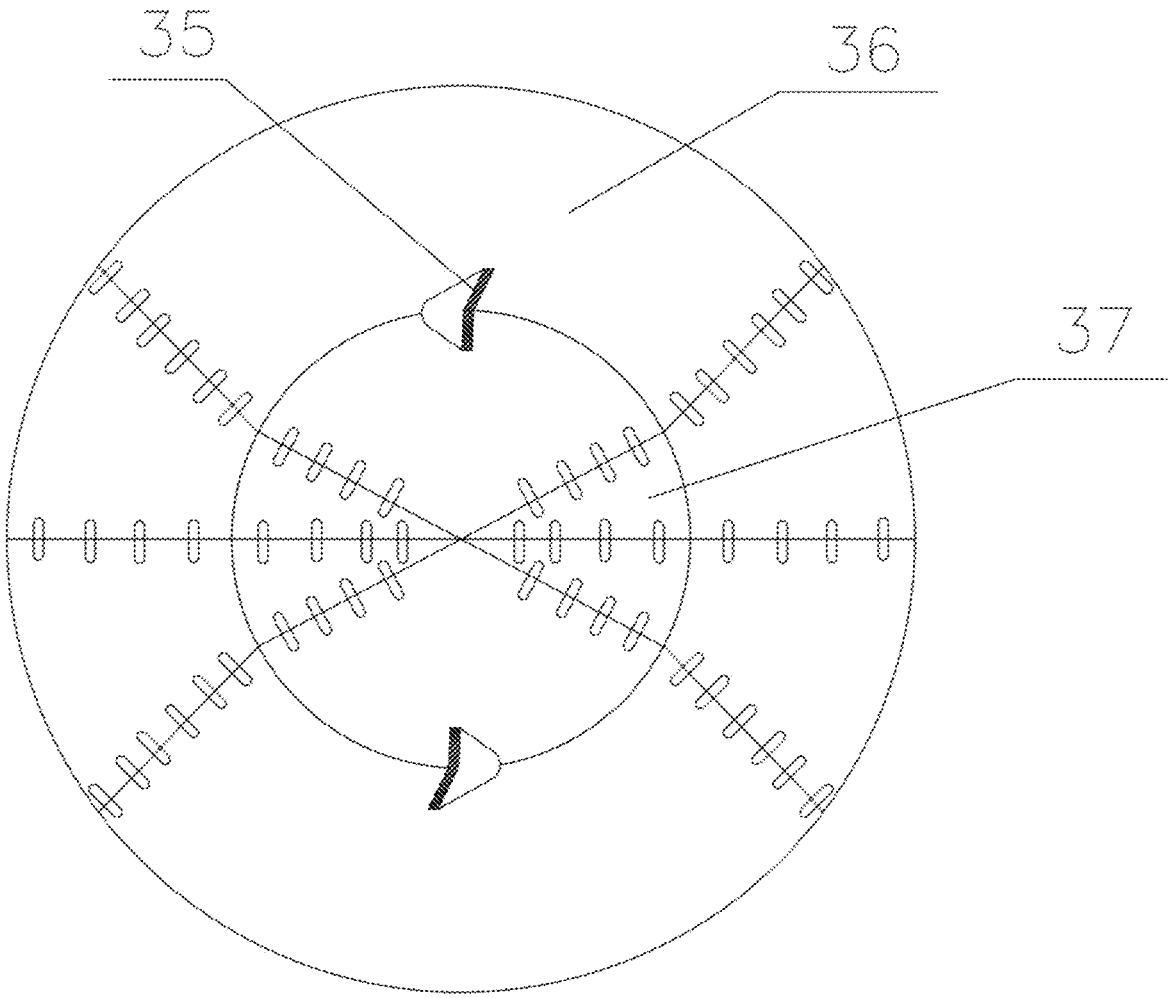
FIG. 2 is a bottom view of a full-face shaft boring machine according to an embodiment of the present disclosure.
Figure 3:
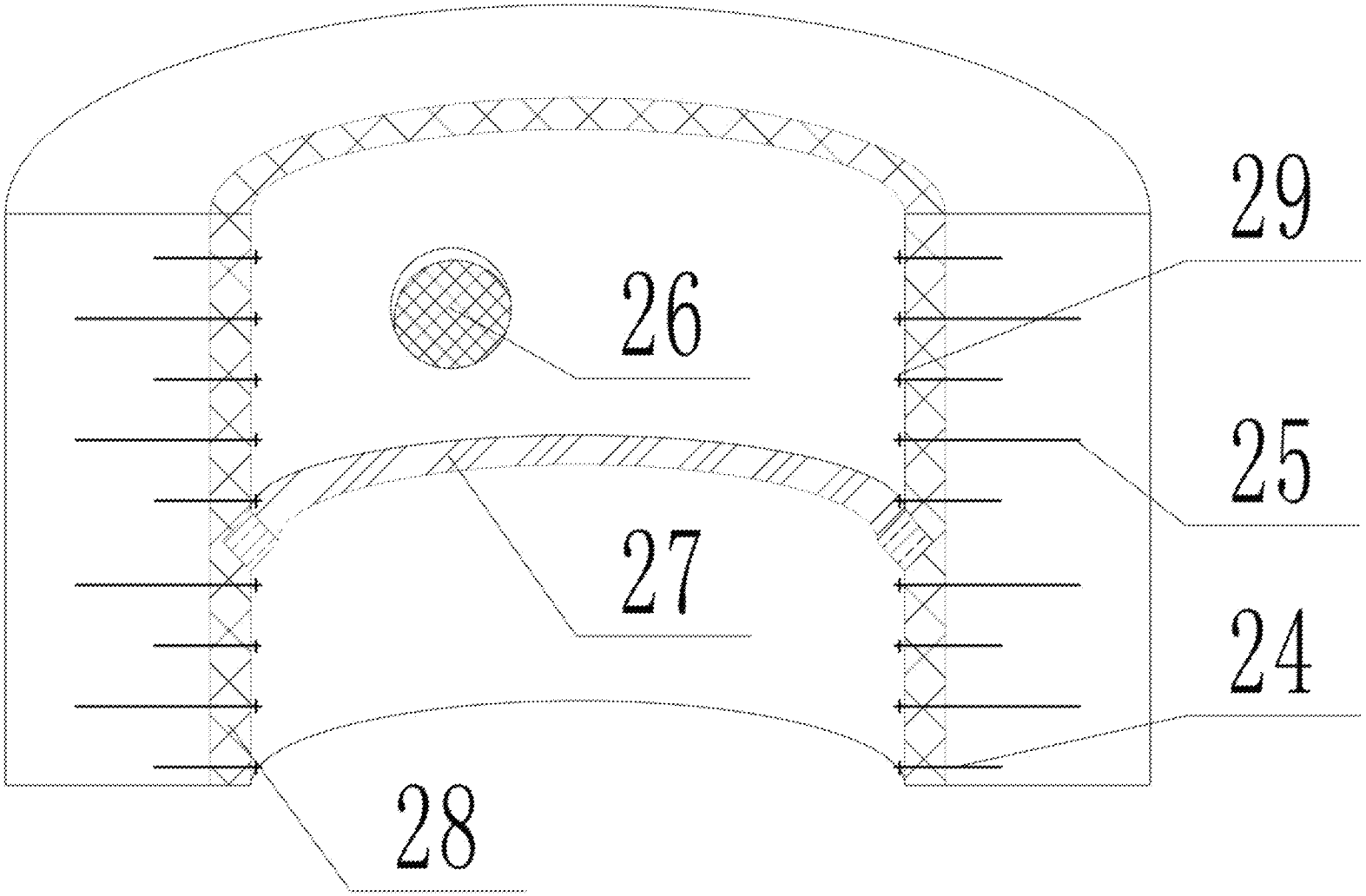
FIG. 3 is a schematic diagram of a supporting form for surrounding rocks of Class I and II according to an embodiment of the present disclosure.
Figure 4:
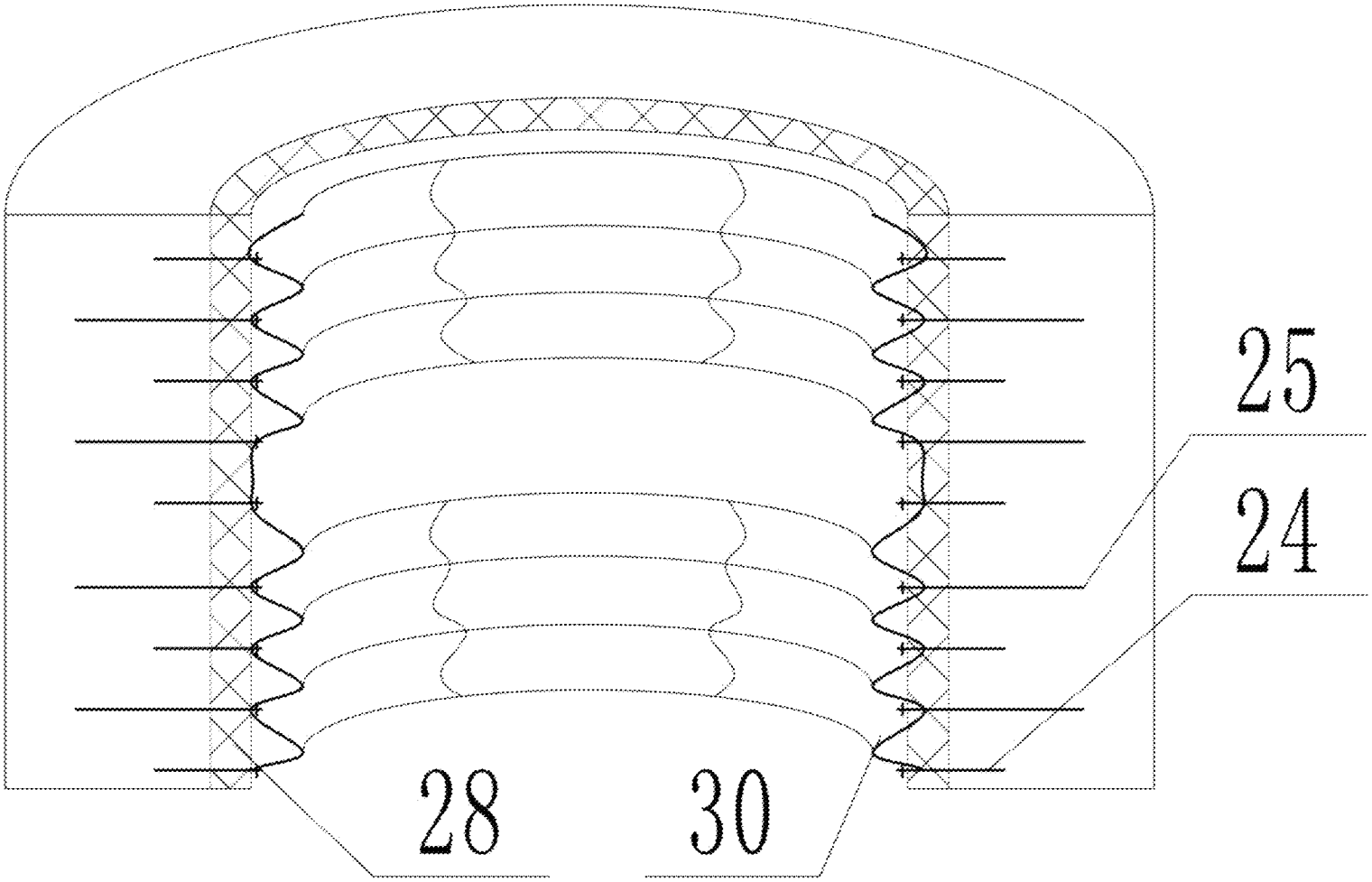
FIG. 4 is a schematic diagram of a supporting form for a surrounding rock of Class III according to an embodiment of the present disclosure.
Figure 5:
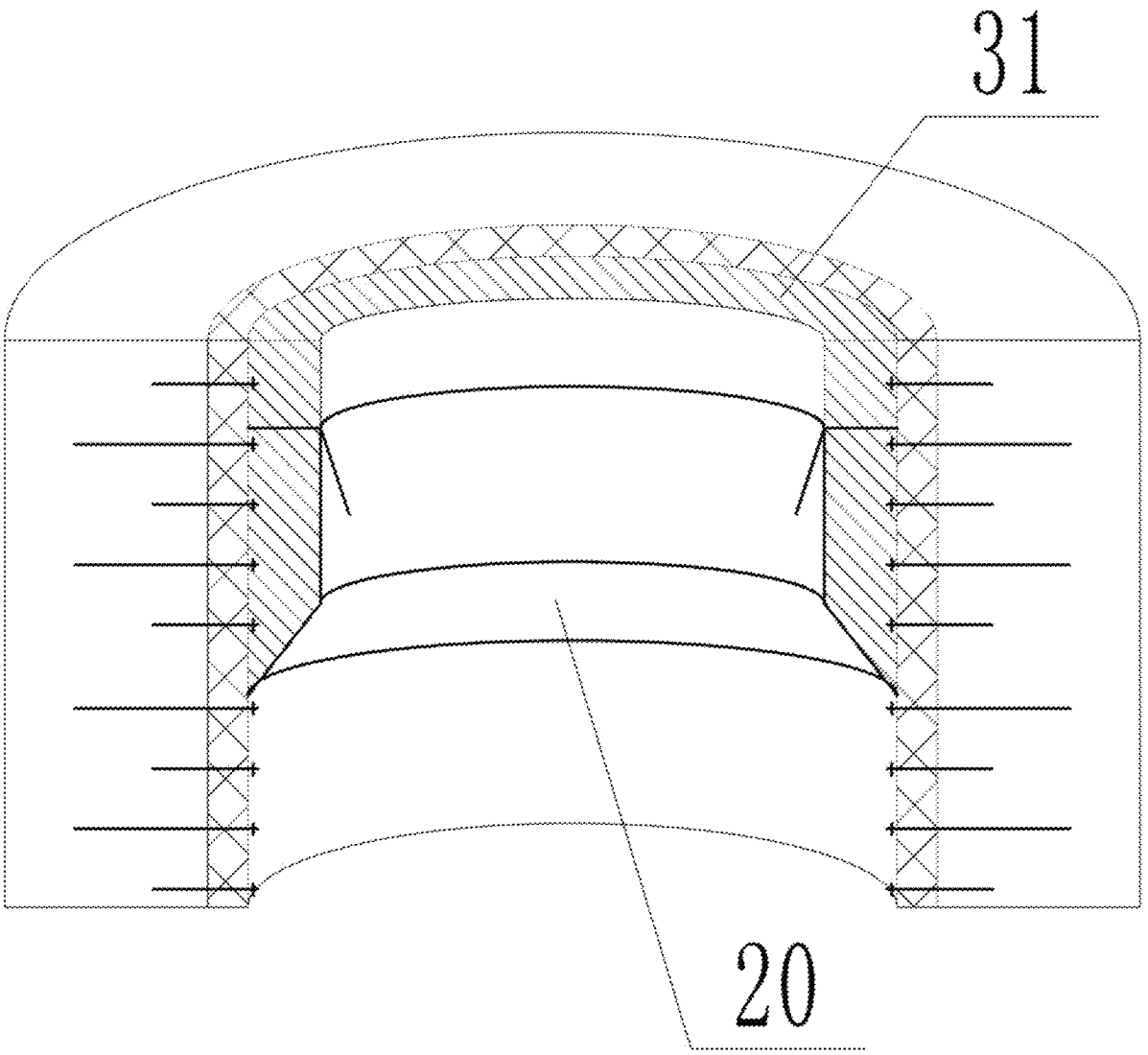
FIG. 5 is a schematic diagram of a supporting form for surrounding rocks of Class IV, V or above according to an embodiment of the present disclosure.
Figure 6:
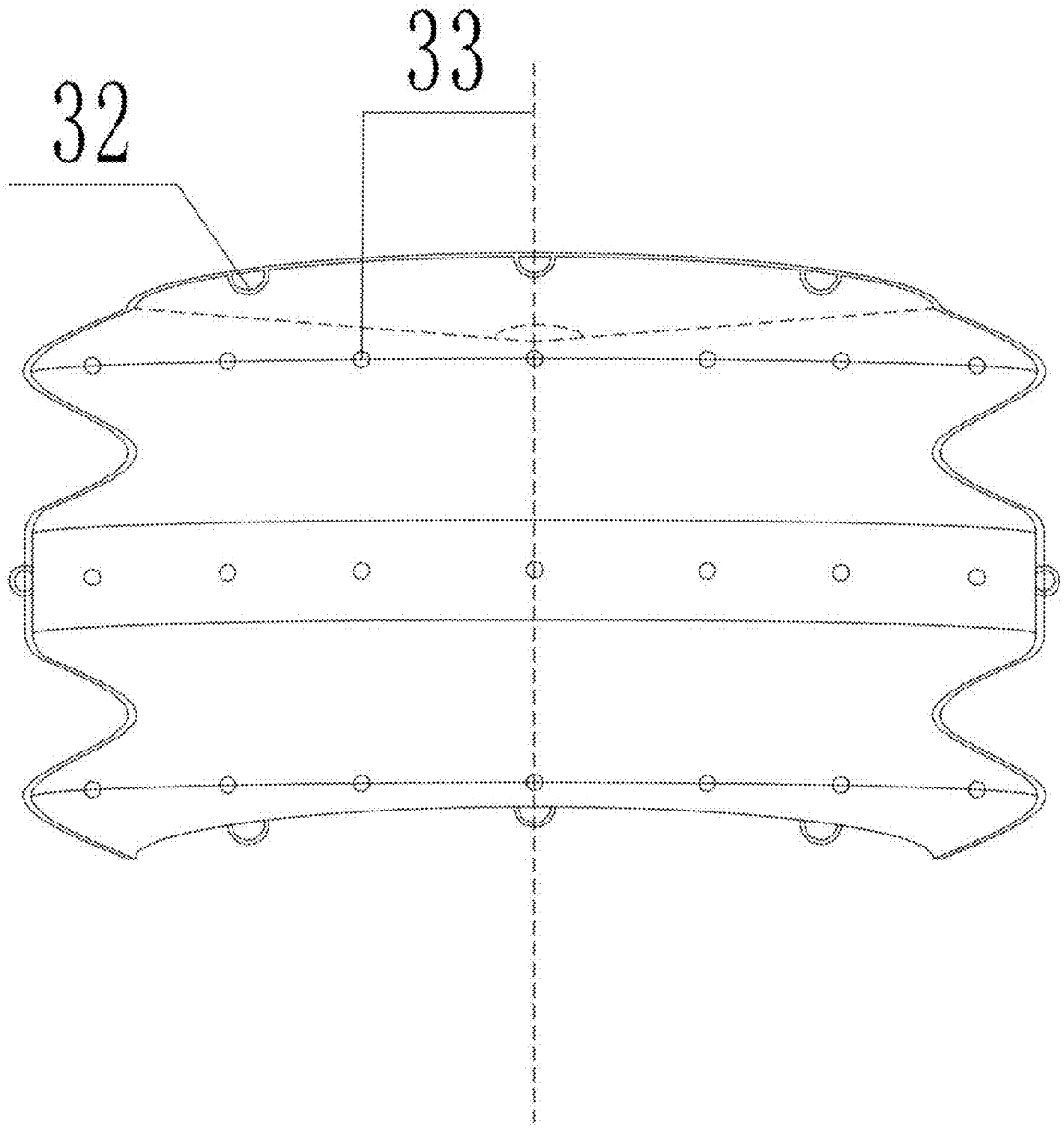
FIG. 6 is a schematic diagram of a corrugated steel tube piece according to an embodiment of the present disclosure.
Figure 7:
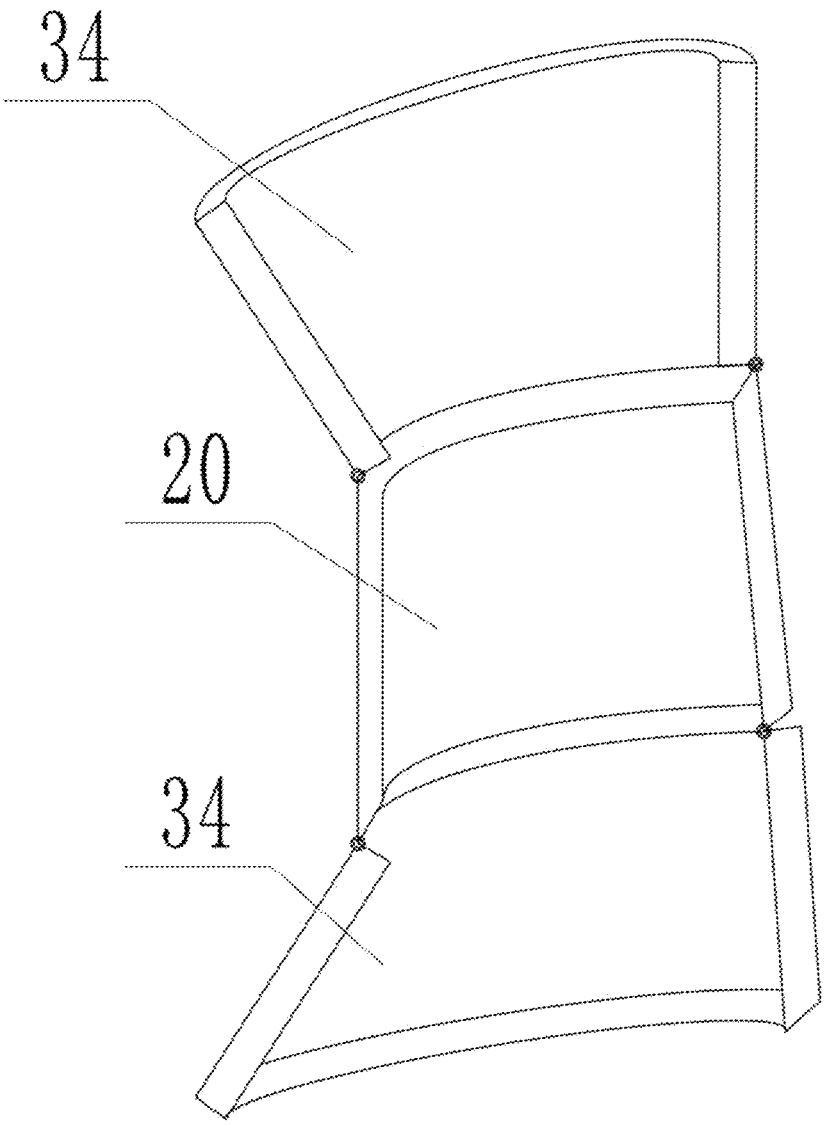
FIG. 7 is a front view of a supporting assembly structure according to an embodiment of the present disclosure.
Figure 8:
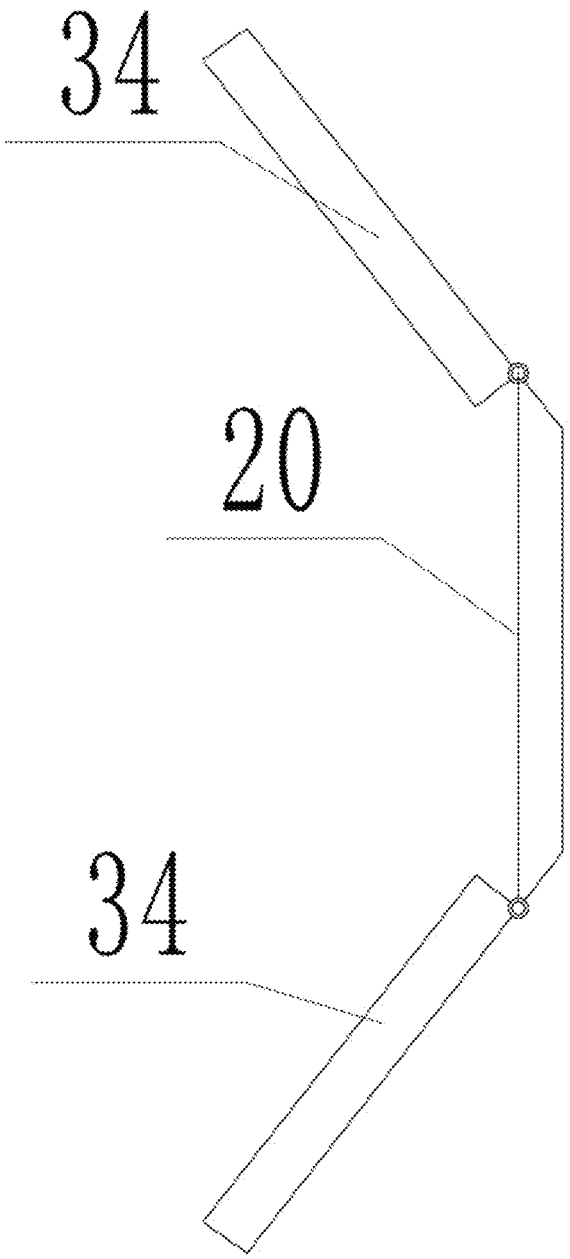
FIG. 8 is a side view of a supporting assembly structure in a opened state according to an embodiment of the present disclosure.
Figure 9:
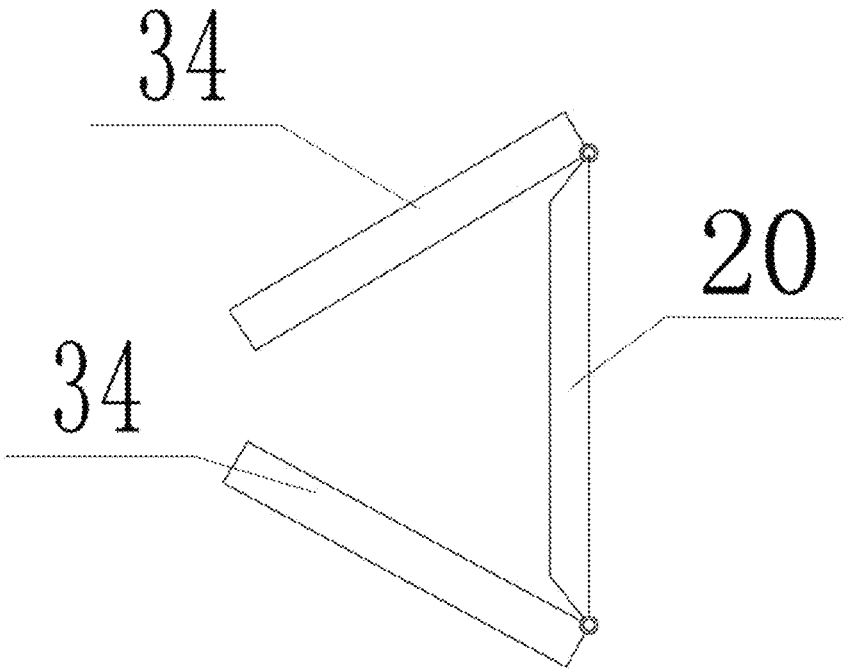
FIG. 9 is a side view of a supporting assembly structure in a closed state according to an embodiment of the present disclosure.

As shown in FIGS. 1 to 9, the embodiment provides a full-face shaft boring machine, including a cutterhead structure 1 provided with at least one outer tapered surface structure 36 protruding in a boring direction, the outer tapered surface structure 36 surrounds an outer circumferential side of the rotation center of the cutterhead structure 1, a radial cross section of the outer tapered surface structure 36 gradually decreases in the boring direction, and boring members of the cutterhead structure 1 include the outer tapered surface structure 36 and hobs for breaking rock that are uniformly distributed in the outer tapered surface of the outer tapered surface structure 36, and improves the rock breaking efficiency by the cooperation between the outer tapered surface structure 36 and the hobs; at least one receiving port 2 for rock slag to pass through is formed at the taper top of the outer tapered surface structure 36, the receiving port 2 runs through the cutterhead structure 1 in the boring direction, and a slag scraper 35 for collecting the rock slag is arranged at the receiving port 2. Specifically, in a shaft boring process, the cutterhead structure 1 bores in a vertical direction, the receiving port 2 formed at the taper top of the outer tapered surface structure 36 is the lowest point. The outer tapered surface structure 36 breaks rocks along with the cutterhead structure 1, so that a bottom wall of the shaft is formed with an annular tapered groove corresponding to the outer tapered surface structure 36. A radial cross section of the annular tapered groove gradually decreases in the boring direction, the rock slag slips downward along an inner wall surface of the annular tapered groove and gradually gathers at the bottom of the annular tapered groove, and the taper top of the outer tapered surface structure 36 is also located at the bottom of the annular tapered groove, so that the gathered rock slag can be scooped up by means of the slag scraper 35, passed through the cutterhead structure 1, and thus piled above the cutterhead structure 1. The whole cutterhead structure 1 is designed such that the rock slag generated in the rock breaking process can be rapidly gathered and quickly moved away from a boring surface through the receiving port 2, so as to effectively improve the boring efficiency and solve the problem that a planar cutterhead in the prior art is not conducive to gathering rock slag during shaft construction which affecting thus the boring efficiency. A slag discharging assembly for discharging the rock slag is arranged on a side of the cutterhead structure 1 away from the boring direction, and the rock slag is delivered out of the shaft by the slag discharging assembly.

Preferably, a partial structure of an outer circumferential edge of the taper bottom of the outer tapered surface structure 36 coincides with an outer circumferential edge of the whole cutterhead structure 1 to ensure that the rock breaking and boring are performed on the whole bottom wall of the shaft by means of the outer tapered surface structure 36, and to ensure that the rock slag generated after rock breaking is performed on the portions, located on an outer circumferential side of the outer tapered surface structure 36, of the bottom wall of the shaft effectively slips off by means of the annular tapered groove formed by the outer tapered surface structure 36, improving the boring efficiency.

In a specific implementation, at least one inner tapered surface structure 37 protruding in a direction opposite the boring direction is coaxially arranged with the cutterhead structure and at the rotation center of the cutterhead structure 1, each of the at least one inner tapered surface structure 37 is surrounded by a corresponding one outer tapered surface structure 36, a number of the at least one inner tapered surface structure 37 is equal to or less than that of the at least one outer tapered surface structure 36 and a radial cross section of the inner tapered surface structure 37 gradually decreases in a direction opposite the boring direction, such that the whole cutterhead structure 1 is of a W-shaped structure; where it should be noted that hobs are also uniformly distributed on the inner tapered surface structure 37. An outer circumferential edge of the taper bottom of the inner tapered surface structure 37 is connected to the outer circumferential edge of the taper top of the outer tapered surface structure 36 to increase a longitudinal depth of the annular tapered groove formed by the outer tapered surface structure 36 in the rock breaking process, thus it is possible to enlarge a breaking surface of the bottom wall of the shaft and fully improve the boring efficiency. Further, by arranging the inner tapered surface structure 37 in an area surrounded by the outer tapered surface structure 36, it is ensured that the rock slag is generated after rock breaking is performed on portions, located on the inner circumferential side of the outer tapered surface structure 36, of the bottom wall of the shaft, and the generated rock slag can rapidly slip off along inner circumferential walls of the annular tapered groove, thus improving the boring efficiency effectively.

Preferably, a taper angle of the outer tapered surface structure 36 ranges from 90° to 110°, and a taper angle of the inner tapered surface structure 37 ranges from 90° to 160°, so as to sufficiently ensure that the rock slag is gathered to the bottom of the annular tapered groove, effectively improving the efficiency of the rock slag passing through the receiving port 2.

In a specific implementation, connection between the outer circumferential edge of the taper bottom of the inner tapered surface structure 37 is connected to the outer circumferential edge of the taper top of the outer tapered surface structure 36 forms an annular collection groove for gathering the rock slag at a side of the cutterhead structure 1 away from the outer tapered surface structure 36, the annular collection groove is in communication with the at least one receiving port 2, and a feeding end of the slag discharging assembly is arranged at the annular collection groove, so that the rock slag passing through the receiving port 2 can be gathered in the annular collection groove, which facilitates the collection and transfer by the slag discharging assembly.

In a specific implementation, the slag discharging assembly includes a dry-type slag discharging mechanism including bucket wheel machines 3, a slag gathering bin 4 and a chain bucket machine 5. The bucket wheel machine 3 includes a reciprocating conveyor mechanism arranged obliquely, a feeding end of which close to the taper top of the outer tapered surface structure 36, that is, close to the annular collection groove and a discharging end of which extends in the direction opposite the boring direction and is close to the rotation center of the cutterhead structure 1, a plurality of scoopers for scooping up the rock slag are arranged on the reciprocating conveyor mechanism to facilitate scooping of the rock slag in the annular collection groove by means of the scoopers. The slag gathering bin 4 is arranged on the side of the cutterhead structure 1 away from the boring direction, spaced from the cutterhead structure 1 and located at the rotation center of the cutterhead structure 1. The slag gathering bin 4 is in communication with the discharging end of the reciprocating conveyor mechanism. The chain bucket machine 5 is located on a side of the slag gathering bin 4 away from the boring direction, a feeding end of the chain bucket machine 5 is in communication with the slag gathering bin 4, and a discharging end of the chain bucket machine 5 extends in the direction opposite the boring direction and is in communication with a rock slag output mechanism. In a case that few water gushes from the formation, the rock slag is discharged out by means of the dry-type slag discharging mechanism. Specifically, the scoopers scoop up the rock slag in the annular collection groove and convey the same to the slag gathering bin 4 by the reciprocating conveyor mechanism, then the rock slag is gathered within the slag gathering bin 4, and conveyed to the rock slag output mechanism by the chain bucket machine 5 and later discharged out of the shaft by the rock slag output mechanism. Preferably, a plurality of bucket wheel machines 3 are provided and surround, at intervals, the outer circumferential side of the rotation center of the cutterhead structure 1 in a circumferential direction, so as to improve the efficiency of conveying of the rock slag.

Preferably, the rock slag output mechanism includes a slag bucket 7 and a slag chute 6 communicating between the slag bucket 7 and the discharging end of the chain bucket machine 5. The top of the slag bucket 7 is opened. The feeding end of the chain bucket machine 5 scoops the rock slag to the discharging end thereof, and then the rock slag falls into the slag chute 6, slips down to the top opening of the slag bucket 7 along the slag chute 6, falls into the slag bucket 7 and is transferred out of the shaft by means of the slag bucket 7.

In a specific implementation, the slag gathering bin 4 is of a tapered cylinder structure with a top opening, a radial cross section of the slag gathering bin 4 gradually decreases in the boring direction, the slag gathering bin 4 is formed with openings at an outer circumferential side of the axis thereof, and the discharging end of the reciprocating conveyor mechanism passes through the opening and is in communication with the slag gathering bin 4. The feeding end of the chain bucket machine 5 extends into the slag gathering bin 4 through the top opening of the slag gathering bin 4 and extends to the taper top of the slag gathering bin 4. The slag gathering bin 4 is designed to be of the tapered cylinder structure such that the rock slag transferred by the bucket wheel machines 3 is gathered into the slag gathering bin 4 and accumulates at a central position of the slag gathering bin 4 under the action of gravity of the rock slag. Preferably, the feeding end of the chain bucket machine 5 is located at the central position of the slag gathering bin 4, so that the rock slag can be rapidly scooped up and the efficiency of conveying the rock slag can be improved.

In a specific implementation, the slag output assembly further includes a wet-type slag discharging mechanism including a slag discharging pipe 8 and a slag slurry pump 9 arranged on the slag discharging pipe 8. A feeding end of the slag discharging pipe 8 is close to the taper top of the outer tapered surface structure 36, and a discharging end of slag discharging pipe 8 extends in the direction opposite the boring direction and is in communication with a rock slag separation station 11. The rock slag separation station 11 is provided with a slag outlet for discharging separated rock slag and a slurry outlet for discharging separated slurry, the slag outlet is in communication with the rock slag output mechanism, the slurry outlet is in communication with a slurry replenishing pipe 10, and a discharging end of the slurry replenishing pipe 10 extends to the taper top of the outer tapered surface structure 36. In a case that much water gushes from the formation, the rock slag is discharged out by mean of the wet-type slag discharging mechanism, the slag discharging pipe 8 and the slurry replenishing pipe 10 are both located on one side of the bucket wheel machine 3. After the slag slurry pump 9 is started, a mixture of the rock slag and the slurry enters the rock slag separation station 11 through the slag discharging pipe 8 and then separated into the rock slag and the slurry by the rock slag separation station 11, the rock slag enters the rock slag output mechanism through the slag outlet, and the slurry is returned to the annular collection groove through the slurry replenishing pipe 10 and is mixed with the rock slag again, so as to achieve recycling. Preferably, the slag outlet is in communication with a slag transferring pipe 12, the rock slag output mechanism is provided with the slag bucket 7 with the top opening, and an outlet of the slag transferring pipe 12 is located above the slag bucket 7, such that the slag transferring pipe 12 pours the rock slag into the slag bucket 7 through the top opening of the slag bucket 7.

Furthermore, the present disclosure provides a boring system, including a full-face shaft boring machine and a supporting assembly matched with the full-face shaft boring machine. The supporting assembly includes a concrete casting formwork 20 adapted to an inner circumferential wall of the shaft. The concrete casting formwork 20 is adjacent to the inner circumferential wall of the shaft, and a first casting structure 31 is connected between the concrete casting formwork and the inner circumferential wall of the shaft. Close-up formworks 34 are arranged respectively above and below the concrete casting formwork 20, one end of one of the close-up formworks 34 is articulated to the top end edge of the concrete casting formwork 20, the other end of the one of the close-up formworks abuts against the inner circumferential wall of the shaft located above the concrete casting formwork 20, one end of the other of the close-up formworks 34 is articulated to the bottom end edge of the concrete casting formwork 20, and the other end of the other close-up formwork abuts against the inner circumferential wall of the shaft located below the concrete casting formwork 20, so as to form, at the top end and the bottom end of the concrete casting formwork 20, a slope surface connected between the concrete casting formwork 20 and a surrounding rock by means of the two close-up formworks 34. This configuration facilitates start and close-up, ensures the stability of the casting structure itself, facilitates forming transition between the casting structure and supports, completing casting of the wall of the shaft with gradually varied thickness, and also achieving casting of the wall of the shaft with different thicknesses. Preferably, both the concrete casting formwork 20 and the close-up formworks 34 are steel plates, and an articulation block is arranged between the concrete casting formwork 20 and the close-up formwork 34 to articulate to each other. In addition, each of the top and the bottom of the concrete casting formwork 20 has a slope angle of about 30°, and fixing holes are arrayed in the concrete casting formwork 20.

In a specific implementation, the boring system further includes a hanging scaffold mechanism. The hanging scaffold mechanism includes at least an upper hanging scaffold 15, a middle hanging scaffold 14 and a lower hanging scaffold 13 that are arranged sequentially in the boring direction. The upper hanging scaffold 15, the middle hanging scaffold 14 and the lower hanging scaffold 13 are separate and fixed at a shaft mouth via a hanging system. An anchor bolt and anchor rope drilling machine 16 and concrete spraying arms 17 are arranged on the lower hanging scaffold 13, an anchor bolt and anchor rope tensioning device 19 and a mobile concrete mixing station 18 are arranged on the middle hanging scaffold 14, and the rock slag output mechanism is arranged on the upper hanging scaffold 15. The concrete spraying arm 17 is in communication with the mobile concrete mixing station 18 through a flexible pipe. The mobile concrete mixing station 18 can feed a spray material to the concrete spraying arm 17, the concrete spraying arm 17 can be deployed to the upper hanging scaffold 15, the middle hanging scaffold 14 and the lower hanging scaffold 13. The supporting assembly is located between the upper hanging scaffold 15 and the middle hanging scaffold 14. Specifically, two anchor bolt and anchor rope drilling machines and two sets of concrete spraying arms 17 are arranged on the lower hanging scaffold 13, two anchor bolt and anchor rope tensioning devices and one mobile concrete mixing station 18 are arranged on the middle hanging scaffold 14, and the slag bucket 7 is arranged on the upper hanging scaffold 15.

The present disclosure further provides a boring method, including the steps S1-S3 as follows:

S1, the cutterhead structure 1 is continuously propelled under the action of a thrust and torque of a main shaft of the boring machine to break a working face rock mass into blocky and powdery rock slag, so that a new working space is formed by downward boring to achieve shaft boring to perform subsequent operations such as supporting therein;

S2, the dry-type slag discharging mechanism is adopted to discharge the rock slag in case that the amount of water gushing from the formation is less than a predetermined value. Specifically, the rock slag is transferred to the slag gathering bin by the bucket wheel machines 3, the rock slag is delivered upward by the chain bucket machine 5, and when reaching the highest point, the rock slag falls onto the slag chute 6 and then slips into the slag bucket 7, the slag bucket 7 is lifted to the ground, and finally the rock slag is discharged to a ground slag yard.

The wet-type slag discharging mechanism is adopted to discharge the rock slag in case that the amount of water gushing from formation is greater than the predetermined value. Specifically, after the slag pump 9 is started, a mixture of rock slag and slurry gathered on the working face enters the rock slag separation station 11 through the slag discharging pipe 8, and is separated into the rock slag and the slurry by the rock slag separation station 11, the rock slag enters the slag bucket 7 through the slag outlet, the slag bucket 7 is lifted to the ground, and finally the rock slag is discharged to the ground slag yard, while the slurry is returned to the annular collection groove through the slurry replenishing pipe 10 and is mixed with the rock slag again. A reasonable slag discharging mode is selected depending on the water content condition on the working face; and S3, when continuously boring is performed by a height of a supporting section, the hanging scaffold mechanism is lowered to the supporting section, and operating personnel enters the lower hanging scaffold 13 to observe the integrity of the surrounding rock at the inner circumferential wall of the shaft and select a required supporting form to support the surrounding rock.

Specifically, in a case that the surrounding rock has high integrity and is classified as a surrounding rock of Class I or Class II 21, a supporting process involving the anchor bolts 24, reinforcing meshes, and concrete spraying is used. The supporting process includes the specific steps as follows:

first, the anchor bolt hole and anchor rope holes are formed by means of the anchor bolt and anchor rope drilling machine 16; second, the double-layer reinforcing meshes 26 are laid at a side wall of the shaft, the anchor bolts 24 and the anchor ropes 25 are mounted to preliminarily fix the reinforcing meshes, then a pretensioning force is applied to anchor bolts and anchor ropes by mean of the anchor bolt and anchor rope tensioning device 19, where since the reinforcing meshes cannot be directly fixed on the surrounding rock at the inner circumferential wall of the shaft, the anchor bolts 24 and the anchor ropes 25 are mounted while the reinforcing meshes are laid, such that the reinforcing meshes are attached to the inner circumferential wall of the shaft to form a whole structure. This way is equivalent to making the inner circumferential wall of the shaft in a compressed stress state while tightly fixing the reinforcing meshes, which is conducive to ensuring the stability of the surrounding rock at the inner circumferential wall of the shaft; third, concrete is sprayed in an area covered by the reinforcing meshes by mean of the concrete spraying arms 17 to form a second casting structure 28, where the concrete is continuously provided by the concrete mixing station in the middle hanging scaffold 14. This way can close the surrounding rock at the inner circumferential wall of the shaft, preventing the surrounding rock at the inner circumferential wall of the shaft from losing water or disintegrating when touching water. Moreover, the sprayed concrete and the reinforcing meshes are combined to form a layer of reinforced concrete structure; and fourth, one reinforcement is performed at intervals of 20 m via steel arches 27, where the steel arch 27 is composed of square steel having a diameter equal to the diameter of the inner circumferential wall of the shaft to achieve reinforced supporting and ensure the supporting structure having rigidity.

In a case that the surrounding rock has general integrity and is classified as a surrounding rock of class III 23, a supporting process involving the anchor bolts 24, the anchor ropes 25, the reinforcing meshes, concrete spraying, corrugated steel is used. The supporting process includes the specific steps as follows:

first, at an initial stage of exposure of the side wall of the shaft formed by excavation, a primary spraying is performed on the side wall of the shaft by means of the concrete spraying arms 17 to rapidly close the surrounding rock, preventing further deterioration of the surrounding rock; second, the anchor bolt hole and anchor rope holes are formed by means of the anchor bolt and anchor rope drilling machine 16; and third, the double-layer reinforcing meshes 26 are laid at the side wall of the shaft, and the anchor bolts 24 and the anchor ropes 25 are mounted in alternate row manner to preliminarily fix the reinforcing meshes; then a pretensioning force is applied to the anchor bolts and anchor ropes by means of the anchor bolt and anchor rope tensioning device 19; and only bolt bodies and rope bodies are mounted in the remaining anchor bolt holes and anchor rope holes without mounting pallets 29. The mounting in the alternate row manner is aimed to connect exposed segments of the remaining row of anchor bolts 24 and anchor ropes 25 to reserved holes 33 of corrugated steel tube pieces 30 for fixing corrugated steel; fourth, concrete is spayed in an area covered by the reinforcing meshes by mean of the concrete spraying arms 17 to form the second casting structure 28; fifth, the corrugated steel is mounted, the pallets 29 are mounted at the ends of the remaining anchor bolts 24 and anchor ropes 25, and a pretensioning force is applied to form a closed supporting loop; and sixth, the corrugated steel tube pieces 30 between an upper section and a lower section are connected by means of connecting bolts to form a continuous supporting structural body. The corrugated steel tube piece 30 is formed by rolling steel plates, and a corrugation spacing and a corrugation amplitude of the corrugated steel are adjusted according to geological conditions. A planar layer arranged in the middle of the corrugated steel tube piece 30 is reserved with round holes having the same spacing as the anchor bolts 24 and the anchor ropes 25 to facilitate mounting and fixing. Hanging lugs 32 are arranged at the upper and lower ends of the corrugated steel tube piece to facilitate allocation and connection between upper and lower sections of the corrugated steel tube pieces. The left and right ends of the corrugated steel tube piece are provided with connecting round holes to facilitate the direct connection between the corrugated steel tube pieces located in the same section.

In a case that the surrounding rock has poor integrity and is classified as a surrounding rock of class IV 22 or the surrounding rock has worse integrity, a supporting process involving the anchor bolts 24, the anchor ropes 25, the reinforcing meshes, concrete spraying, the corrugated steel, secondary concrete lining is used. The supporting process includes the specific steps as follows:

first, at an initial stage of exposure of the side wall of the shaft formed by excavation, a primary spraying is performed on the side wall of the shaft by means of the concrete spraying arms 17 to rapidly close the surrounding rock, preventing further deterioration of the surrounding rock; second, the anchor bolt hole and anchor rope holes are formed by means of the anchor bolt and anchor rope drilling machine 16; third, the double-layer reinforcing mesh 26 are laid at the side wall of the shaft, and the anchor bolts 24 and the anchor ropes 25 are mounted to preliminarily fix the reinforcing meshes; then a pretensioning force is applied to the anchor bolts and anchor ropes by means of the anchor bolt and anchor rope tensioning device 19; fourth, concrete is sprayed in an area covered by the reinforcing meshes by means of the concrete spraying arms 17 to form the second casting structure 28; fifth, the steel arches 27 are mounted at intervals of 0.8~2 m according to the condition of the formation to form a closed supporting loop; sixth, the supporting assembly is lowered, the close-up formwork 34 located above the concrete casting formwork 20 is opened, and concrete is casted to form a slope surface engaging with a supporting structure in the upper section; seventh, the close-up formwork 34 located below the concrete casting formwork 20 is opened, and concrete is casted to form a close-up slope surface engaging with the other supporting structures in the lower section; and eighth, when needing further reinforcement, steel bars can be laid before casting the concrete to form a steel-concrete composite structure.

The whole boring method first uses the cutterhead structure 1 to break the rock, then uses the dry-type or wet-type slag discharging mechanism to discharge the rock slag, and finally completes shaft supporting according to the geological conditions, such that the efficiency of shaft construction can be effectively improved, and the labor intensity of workers can be reduced.

Adaptive changes made according to actual needs are all within the scope of protection of the present disclosure.

It should be noted that it is obvious to those skilled in the art that the present disclosure is not limited to the details of the above exemplary embodiments, and that the present disclosure can be implemented in other specific forms without departing from the spirit or basic features of the present disclosure. Accordingly, the embodiments should be regarded in all points of view as exemplary and not restrictive, the scope of the present disclosure being defined by the appended claims rather than the foregoing description, and it is therefore intended that all changes falling within the meaning and scope of equivalent elements of the claims should be included in the present disclosure. Any reference sign in the claims should not be considered as limiting the involved claims.

In the present disclosure, the principle and embodiments of the present disclosure are described herein by using specific examples, the above descriptions of the embodiments are merely intended to help understand the methods and core idea of the present disclosure. In addition, for those of ordinary skill in the art, changes may be made to the specific embodiments and the scope of application according to the concept of the present disclosure. In summary, the content of the description should not be construed as a limitation to the present disclosure.

What is claimed is:

1. A full-face shaft boring machine, comprising a cutterhead structure provided with an outer tapered surface structure protruding in a boring direction, wherein the outer tapered surface structure surrounds an outer circumferential side of a rotation center of the cutterhead structure, and a radial cross section of the outer tapered surface structure gradually decreases in the boring direction; at least one receiving port for rock slag to pass through is formed at a taper top of the outer tapered surface structure and runs through the cutterhead structure in the boring direction, and a slag discharging assembly for discharging the rock slag is arranged on a side of the cutterhead structure away from the boring direction, wherein an inner tapered surface structure protruding in a direction opposite the boring direction is coaxially arranged with the cutterhead structure and at the rotation center of the cutterhead structure, a radial cross section of the inner tapered surface structure gradually decreases in the direction opposite the boring direction, and an outer circumferential edge of a taper bottom of the inner tapered surface structure is connected to an outer circumferential edge of the taper top of the outer tapered surface structure.

2. The full-face shaft boring machine according to claim 1, wherein a taper angle of the outer tapered surface structure ranges from 90° to 110°, and a taper angle of the inner tapered surface structure ranges from 90° to 160°.

3. The full-face shaft boring machine according to claim 2, wherein connection between the outer circumferential edge of the taper bottom of the inner tapered surface structure and the outer circumferential edge of the taper top of the outer tapered surface structure forms an annular collection groove for gathering the rock slag, the annular collection groove is in communication with the at least one receiving port, and a feeding end of the slag discharging assembly is arranged at the annular collection groove.

4. The full-face shaft boring machine according to claim 1, wherein the slag discharging assembly comprises a dry-type slag discharging mechanism comprising bucket wheel machines, a slag gathering bin and a chain bucket machine, wherein each of the bucket wheel machines comprises a reciprocating conveyor mechanism arranged obliquely, a feeding end of the reciprocating conveyor mechanism is close to the taper top of the outer tapered surface structure, a discharging end of the reciprocating conveyor mechanism extends in the direction opposite the boring direction and is close to the rotation center of the cutterhead structure, and a plurality of scoopers for scooping up the rock slag are arranged on the reciprocating conveyor mechanism;

the slag gathering bin is arranged on the side of the cutterhead structure away from the boring direction, spaced from the cutterhead structure and located at the rotation center of the cutterhead structure, and the slag gathering bin is in communication with the discharging end of the reciprocating conveyor mechanism; and the chain bucket machine is located on a side of the slag gathering bin away from the boring direction, a feeding end of the chain bucket machine is in communication with the slag gathering bin, and a discharging end of the chain bucket machine extends in the direction opposite the boring direction and is in communication with a rock slag output mechanism.

5. The full-face shaft boring machine according to claim 4, wherein a taper angle of the outer tapered surface structure ranges from 90° to 110°, and a taper angle of the inner tapered surface structure ranges from 90° to 160°.

6. The full-face shaft boring machine according to claim 5, wherein connection between the outer circumferential edge of the taper bottom of the inner tapered surface structure and the outer circumferential edge of the taper top of the outer tapered surface structure forms an annular collection groove for gathering the rock slag, the annular collection groove is in communication with the at least one receiving port, and a feeding end of the slag discharging assembly is arranged at the annular collection groove.

7. The full-face shaft boring machine according to claim 4, wherein the slag gathering bin is of a tapered cylinder structure with a top opening, a radial cross section of the slag gathering bin gradually decreases in the boring direction, the slag gathering bin is formed with openings at an outer circumferential side of an axis of the slag gathering bin, and the discharging end of the reciprocating conveyor mechanism passes through a corresponding one of the openings and is in communication with the slag gathering bin; the feeding end of the chain bucket machine extends into the slag gathering bin through the top opening of the slag gathering bin and extends to a taper top of the slag gathering bin.

8. The full-face shaft boring machine according to claim 7, wherein a taper angle of the outer tapered surface structure ranges from 90° to 110°, and a taper angle of the inner tapered surface structure ranges from 90° to 160°.

9. The full-face shaft boring machine according to claim 8, wherein connection between the outer circumferential edge of the taper bottom of the inner tapered surface structure and the outer circumferential edge of the taper top of the outer tapered surface structure forms an annular collection groove for gathering the rock slag, the annular collection groove is in communication with the at least one receiving port, and a feeding end of the slag discharging assembly is arranged at the annular collection groove.

10. The full-face shaft boring machine according to claim 7, wherein the slag discharging assembly further comprises a wet-type slag discharging mechanism comprising a slag discharging pipe and a slag slurry pump arranged on the slag discharging pipe, wherein a feeding end of the slag discharging pipe is close to the taper top of the outer tapered surface structure, and a discharging end of the slag discharging pipe extends in the direction opposite the boring direction and is in communication with a rock slag separation station; the rock slag separation station is provided with a slag outlet for discharging separated rock slag and a slurry outlet for discharging separated slurry, the slag outlet is in communication with the rock slag output mechanism, the slurry outlet is in communication with a slurry replenishing pipe, and a discharging end of the slurry replenishing pipe extends to the taper top of the outer tapered surface structure.

11. The full-face shaft boring machine according to claim 10, wherein a taper angle of the outer tapered surface structure ranges from 90° to 110°, and a taper angle of the inner tapered surface structure ranges from 90° to 160°.

12. The full-face shaft boring machine according to claim 11, wherein connection between the outer circumferential edge of the taper bottom of the inner tapered surface structure and the outer circumferential edge of the taper top of the outer tapered surface structure forms an annular collection groove for gathering the rock slag, the annular collection groove is in communication with the at least one receiving port, and a feeding end of the slag discharging assembly is arranged at the annular collection groove.

13. A boring system comprising a full-face shaft boring machine of claim 1 and a supporting assembly associated with the full-face shaft boring machine, wherein the supporting assembly comprises a concrete casting formwork adapted to an internal circumferential wall of the shaft; the concrete casting formwork is adjacent to the inner circumferential wall of the shaft, and a first casting structure is connected between the concrete casting formwork and the inner circumferential wall of the shaft; close-up formworks are arranged respectively above and below the concrete casting formwork, one end of one of the close-up formworks is articulated to a top end edge of the concrete casting formwork, an other end of the one of the close-up formworks abuts against the inner circumferential wall of the shaft located above the concrete casting formwork, one end of an other of the close-up formworks is articulated to a bottom end edge of the concrete casting formwork, and an other end of the other of the close-up formworks abuts against the inner circumferential wall of the shaft located below the concrete casting formwork.

14. The full-face shaft boring machine according to claim 13, wherein a taper angle of the outer tapered surface structure ranges from 90° to 110°, and a taper angle of the inner tapered surface structure ranges from 90° to 160°.

15. The full-face shaft boring machine according to claim 14, wherein connection between the outer circumferential edge of the taper bottom of the inner tapered surface structure and the outer circumferential edge of the taper top of the outer tapered surface structure forms an annular collection groove for gathering the rock slag, the annular collection groove is in communication with the at least one receiving port, and a feeding end of the slag discharging assembly is arranged at the annular collection groove.

16. The full-face shaft boring machine according to claim 13, wherein the slag discharging assembly comprises a dry-type slag discharging mechanism comprising bucket wheel machines, a slag gathering bin and a chain bucket machine, wherein each of the bucket wheel machines comprises a reciprocating conveyor mechanism arranged obliquely, a feeding end of the reciprocating conveyor mechanism is close to the taper top of the outer tapered surface structure, a discharging end of the reciprocating conveyor mechanism extends in the direction opposite the boring direction and is close to the rotation center of the cutterhead structure, and a plurality of scoopers for scooping up the rock slag are arranged on the reciprocating conveyor mechanism;

the slag gathering bin is arranged on the side of the cutterhead structure away from the boring direction, spaced from the cutterhead structure and located at the rotation center of the cutterhead structure, and the slag gathering bin is in communication with the discharging end of the reciprocating conveyor mechanism; and the chain bucket machine is located on a side of the slag gathering bin away from the boring direction, a feeding end of the chain bucket machine is in communication with the slag gathering bin, and a discharging end of the chain bucket machine extends in the direction opposite the boring direction and is in communication with a rock slag output mechanism.

17. The boring system according to claim 13, further comprising a hanging scaffold mechanism comprising at least an upper hanging scaffold, a middle hanging scaffold and a lower hanging scaffold that are arranged sequentially in the boring direction;

wherein an anchor bolt and anchor rope drilling machine and concrete spraying arms are arranged on the lower hanging scaffold, an anchor bolt and anchor rope tensioning device and a mobile concrete mixing station are arranged on the middle hanging scaffold, and a rock slag output mechanism is arranged on the upper hanging scaffold; the concrete spraying arms are in communication with the mobile concrete mixing station through flexible pipes and capable of being deployed to the upper hanging scaffold, the middle hanging scaffold and the lower hanging scaffold; and the supporting assembly is located between the upper hanging scaffold and the middle hanging scaffold.

18. A boring method applying the boring system of claim 17, comprising

S1, continuously propelling the cutterhead structure under action of a thrust and torque of a main shaft of the boring machine to break a working face rock mass into blocky and powdery rock slag;

S2, adopting the dry-type slag discharging mechanism to discharge the rock slag in a case that an amount of water gushing from formation is less than a predetermined value, and adopting the wet-type slag discharging mechanism to discharge the rock slag in a case that the amount of water gushing from formation is greater than the predetermined value; and S3, when continuously boring is performed by a height of a supporting section, lowering the hanging scaffold mechanism to the supporting section, and operating personnel entering the lower hanging scaffold to observe an integrity of a surrounding rock at the inner circumferential wall of the shaft and select a required supporting form to support the surrounding rock.

* * * * *